US010239232B2

(12) United States Patent
O'Brien

(10) Patent No.: US 10,239,232 B2
(45) Date of Patent: Mar. 26, 2019

(54) BOLSTER

(71) Applicant: Kevin John O'Brien, Ware (GB)

(72) Inventor: Kevin John O'Brien, Ware (GB)

( * ) Notice: Subject to any disclaimer, the term of this patent is extended or adjusted under 35 U.S.C. 154(b) by 0 days.

(21) Appl. No.: 14/825,439

(22) Filed: Aug. 13, 2015

(65) Prior Publication Data

US 2017/0043500 A1 Feb. 16, 2017

(51) Int. Cl.
*B28D 1/26* (2006.01)
*B28D 1/22* (2006.01)

(52) U.S. Cl.
CPC ..... *B28D 1/26* (2013.01); *B28D 1/223* (2013.01)

(58) Field of Classification Search
CPC ..... B28D 1/223; B28D 1/26; B28D 1/265; B28D 1/28
See application file for complete search history.

(56) References Cited

U.S. PATENT DOCUMENTS 884,374 A * 4/1908 Everett ..... B28D 1/26 125/6
1,631,693 A * 6/1927 Richey ..... B28D 1/26 175/407
1,660,507 A * 2/1928 Hansen ..... B25D 17/02 175/416
2,090,471 A * 8/1937 Coffey ..... B28D 1/26 125/23.01
2,436,686 A * 2/1948 Coffey ..... B25D 3/00 125/40
2,577,535 A * 12/1951 Mackenzie ..... B28D 1/26 125/40
2,772,671 A * 12/1956 Nowak ..... B28D 1/223 125/23.01
2,780,867 A * 2/1957 Chapla ..... B28D 1/26 30/167.2
3,978,842 A * 9/1976 Coffman ..... B28D 1/223 125/23.01
4,848,309 A * 7/1989 Alderete ..... B25D 3/00 125/40

* cited by examiner

*Primary Examiner* — Timothy V Eley
(74) *Attorney, Agent, or Firm* — Invention To Patent Services; Alex Hobson

(57) ABSTRACT

The present invention provides a long-bladed bolster 1, comprising a substantially planar cutting body 2 having one edge formed as a blade 3 of sufficient length so that the blade 3 is arranged in use to be positioned substantially centrally on a concrete masonry unit (CMU) to enable the block to be divided without the bolster 1 requiring repositioning, the bolster having a striking body on a second long edge of the cutting body opposite to the cutting blade configured to receive repeated blows from a striking implement in use and to transmit these through the cutting body to the blade and the bolster having an integral handle that extends from the cutting body and/or striking body of the bolster substantially centrally along the length of the cutting body 2 and substantially orthogonally to the plane thereof.

12 Claims, 3 Drawing Sheets

BOLSTER

BACKGROUND OF THE INVENTION

Field of the Invention

The present invention relates to bolsters, in particular a bolster for cutting a breeze block or concrete masonry unit. More particularly, but not exclusively, the present invention relates to a bolster with a blade that has a length substantially similar to the depth of a standard breeze block or concrete masonry unit.

Background

Bolsters are typically formed of a piece, with a blade providing a cutting body with a shaft extending therefrom and topped with a striking body distal to the blade, wherein in use a user grasps the shaft and hits the striking body formed by the shaft top.

Concrete masonry units (CMUs)—also called breeze blocks, concrete blocks, cement blocks, besser blocks, and foundation blocks—are large rectangular bricks used in construction. These are usually provided in standard sizes, for example 440 mm long by 215 mm deep by 100 mm high in the UK, making a depth of 225 mm with a mortar joint. These sizes are representative of the overall size when the block is used in a wall, inclusive of mortar joints. The actual size of the individual blocks is usually about 9.5 mm smaller to allow for the mortar joints.

If the construction calls for a wall or other item that cannot be created using a whole number of blocks laid end-to-end or side-to-side, then a number of blocks, namely one per course, will be cut down in length to the requisite size so that the wall or other item can be constructed to the required overall length to finalise the construction. The cutting operations are often done with a tool such as a bolster. Conventional bolsters are generally cold chisels that have a tall shank for gripping and holding upright and a sturdy substantially flat blade at the lower in use end of the shank to penetrate and then cleave a block when the upper in use end of the bolster is struck with a hammer/mallet. However, the blades of these tools generally have a length of around 50 mm to 100 mm, which is only half of the depth of a standard breeze block. This means that cutting the block usually requires a user to make a number of cuts aligned end-to-end over the depth of the block in order to create a cut over the full depth and thus cut the block down to the required length. This takes time and requires concentration and skill to ensure that the individual cuts are straight and correctly aligned.

A number of prior patent applications have sought to improve bolster design and means for splitting concrete blocks, including the following:

US20130340739 describes and shows an apparatus for producing concrete blocks having projections disposed on each side of a splitting line and which engage the workpiece to split it into two pieces.

CN202416884U describes and shows a detachable brick axe comprising an axe body, an axe handle, fixing holes, fixing nuts and a mounting groove, wherein positioning holes are formed in the upper side of the axe body; the mounting groove is formed in the axe handle; and the axe body and the axe handle are fixedly mounted through the fixing nuts.

WO200754711 describes and shows a tool adapted for splitting masonry blocks, comprising a substantially 'C' shaped rigid frame, the stem of the 'C' being provided with a cutting member, arranged so that the limbs of the frame are at opposite ends of the cutting member to cut into the side faces of the block in use. This frame has a handle projecting from the frame longitudinally/in the plane of the blade at one end of the blade aligned with the line of cut, or above it as per conventional bolsters, for holding the frame and blade upright when striking the frame to cut the block. The frame is difficult to manage in use and especially when the handle is at one end and further when positioned above the blade the handle must have a guard to protect the user's hand from being struck.

GB 2411146 describes and shows a templating tool adapted for length position gauging for splitting multiple masonry blocks repeatedly at the same pre-defined length, the templating tool comprising a frame with an arm that sits onto the block with a lug to fix the cutting distance and having a vertical sleeve to slidingly carry the bolster for splitting the blocks. The templating tool's frame has a handle. The bolster has no handle other than its own vertical shank and is not hand-held in use. It is steadied and guided by the templating frame. The templating frame and the templating frame's handle remain still in use while the bolster is struck and travels down through the sleeve of the templating frame to penetrate the block.

In contrast to all of the above the present invention provides a simple one-piece tool that is simple and intuitive to use, easy and quick to position and hold stably and without need of any frame or hand guard, and which can cut a standard breeze block or concrete masonry unit to desired length without requiring repositioning across the depth of the block, and being small and portable enough to fit in a toolbag.

SUMMARY OF THE INVENTION

According to a first aspect of the present invention there is provided a long-bladed bolster, comprising a substantially planar cutting body having a first long edge formed as a blade of sufficient length such that the blade is arranged in use to be positioned substantially centrally across a Concrete masonry unit (CMU) to enable the block to be divided without the bolster requiring repositioning, wherein the bolster has a striking body on a second long edge of the cutting body opposite to the cutting blade configured to receive repeated blows from a striking implement in use and transmit these through the cutting body to the blade and the bolster has an integral handle that extends from the planar cutting body and/or the striking body of the bolster from part way along the length of the cutting body and transverse to the plane thereof. Preferably the handle extends substantially orthogonally from the plane of the cutting body. Preferably the handle extends from substantially centrally along the length of the cutting body.

The bolster allows a user to position the tool where required and then divide the block without the need for repositioning across the depth of the CMU making multiple end-to-end cuts. Furthermore, the bolster is compact and sturdy, stable and easy for the user to hold and to use and is able to be struck with a tool such as a hammer and the planar body driven down through the CMU to the required depth to shear it without the user needing to have their hand guarded by a hand guard while doing so. The handle is integrally formed or integrally assembled to the bolster and is part of the bolster and moves with it when the bolster is struck by a hammer.

By counter-intuitively locating the handle of the bolster mounted in a position on the planar cutting body of the bolster extending transverse/substantially orthogonally from it, rather than at one end of it or on a shaft directly above it, the user's hand is closer to the central striking zone for optimal stability and ease of use yet sufficiently oft-set from it to not be at significant risk of being struck. The handle suitably joins to the cutting body below the striking body approximately half way up from the blade edge. It is spaced from the blade edge by a clearance that is sufficient to allow the planar body to travel down into the CMU and split the CMU apart yet without the handle obstructing the motion. In furtherance of this the handle preferably is of a form with an arm that projects and then rises at a steep angle from the planar body as will be described further below.

Typically the blade may be at least 200 mm in length. This allows the bolster to be used with standard-size CMUs of the smallest size. Advantageously the blade may be substantially around 230 mm in length. This allows the bolster to be used with all standard sizes of CMU. The bolster has a striking body/anvil on the opposite edge of the cutting body to the cutting blade configured to receive repeated blows from a striking implement in use and transmit these through the cutting body to the blade. Ideally the cutting body and the striking body are intimately and securely bonded. This provides a surface onto which a hammer or other striking implement can be struck and helps to ensure that striking forces are received and transmitted effectively. Advantageously the striking body may comprise a solid flat-topped body, which helps to ensure that striking forces are received and transmitted effectively. The striking body may be welded to the edge of the cutting body. This allows the blade and body to be formed separately from the required materials and to the required dimensions. In other embodiments the striking body and cutting body may be an integral cast whole. The striking body may be formed as an integral extension of the cutting body, allowing the bolster to be simply and easily formed and providing a strong form of construction. The striking body is suitably located substantially centrally on the edge of the cutting body, helping to ensure that striking forces are received and transmitted effectively.

With the long-bladed bolster the arrangement of the handle is further advantageous as a conventional tall vertical shank held bolster is liable to have a shaft of excessive weight, particularly where the vertical handle shaft also provides the striking body. Displacement of the striking body/striking point relative to the hand permits safer striking, of special usefulness for the long-bladed bolster in view of the greater than normal striking force required. When splitting breeze blocks or the like, repositioning, stable holding and repeated secure striking is facilitated by the handle.

Particularly preferably the handle comprises an arm connected at an inner end to a major planar face of the cutting body and having a handle grip, for example a knob, configured to fit within a user's hand connected to the outer end. The arm allows the handle to extend a distance to keep the handle knob a safe distance from the striking body. Preferably the handle arm is angled steeply upwards, allowing a user to keep their hand clear above the CMU in use while the end of the arm where it joins to the planar cutting body is of low profile from the body. The handle grip may be a knob that is substantially spherical or bulbous, providing a good shape for grasping. The handle is preferably welded to the cutting body or bolted to the cutting body by a bolt passing through the cutting body axially into or from the handle.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
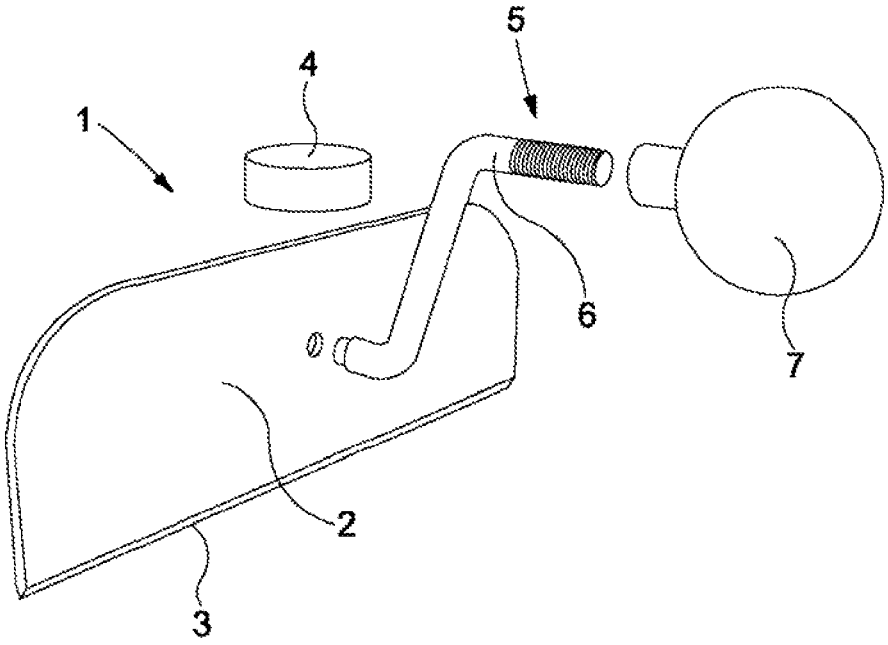
FIG. 1 shows a perspective exploded view from the front and to one side of the preferred embodiment of the long-bladed bolster of the present invention, the bolster comprising a planar cutting body having a blade formed on one edge, a striking plate on the opposed, upper in use, edge, and a handle that extends substantially orthogonally from one major planar face of the cutting body.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

The preferred embodiment of the bolster of the present invention will now be more particularly described, by way of example, only with reference to the afore-mentioned figures.

As shown in FIGS. 1 to 4, the bolster 1 is a long-bladed bolster that lacks an upright shank unlike conventional bolsters. It comprises a substantially planar cutting body 2 having a first major edge formed as a blade 3. The blade 3 runs the full length of the body 2. The planar body 2 is of sufficient length so that the blade 3 can be positioned substantially centrally on a concrete masonry unit or CMU (that is, spanning the depth of the CMU across the length thereof, with the ends of the body generally equidistant from the sides of the CMU), and will extend most or all of the way to each side of the CMU, or slightly overlap the sides of the CMU. The CMU block can be divided without the bolster 1 requiring repositioning. This allows a user to position the tool where required and then divide the block without the need for repositioning and making multiple end-to-end cuts. Given the standard sizes of CMUs, it is advantageous if the cutting body 2/blade 3 is at least 200 mm in length, and preferably around 230 mm in length. The long length allows the bolster 1 to be used with all standard sizes of CMU, overlapping the sides of the narrower ones.

Figure 5A:
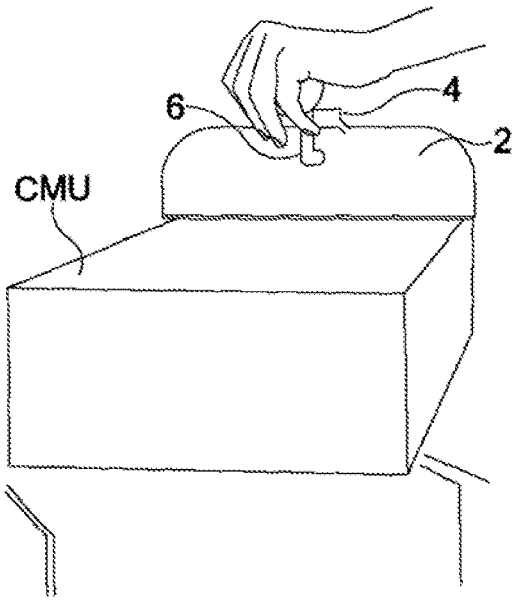
FIGS. 5A to 5C show perspective views from the left side and to the right side, and from above, respectively, of the long-bladed bolster in successive steps of use to split a CMU block.
Figure 5B:
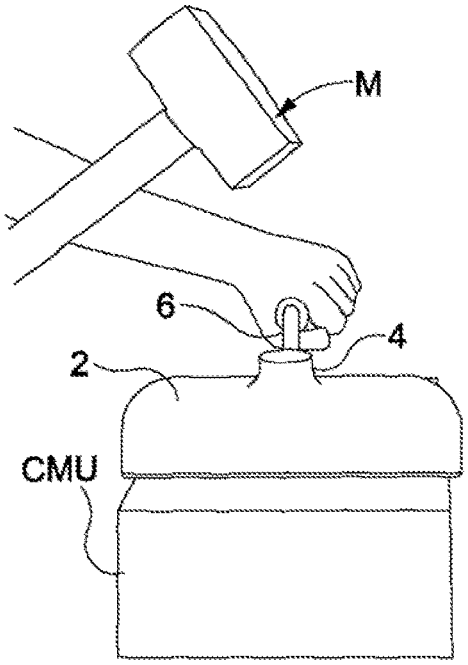
Figure 5C:
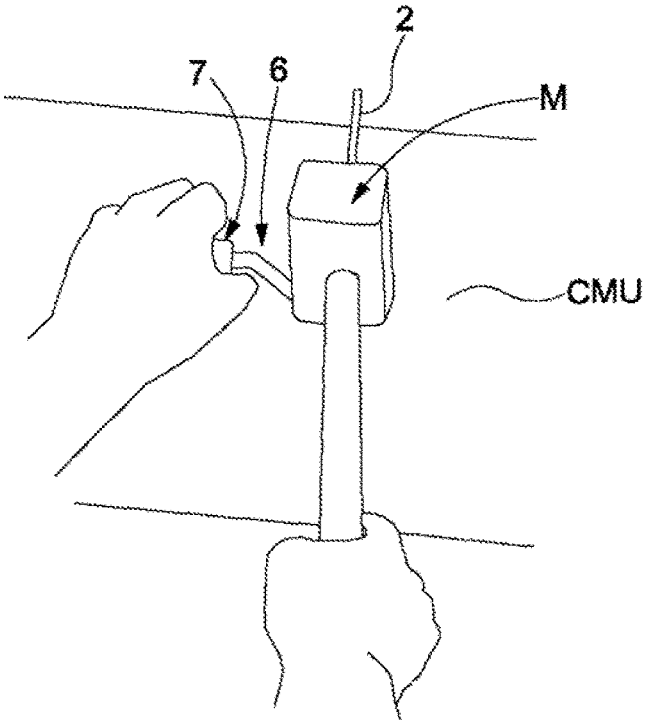

A striking body 4 is located on the opposite edge of the body 2 to the cutting blade 3, ie at the upper in use edge. To use the bolster, as shown in FIGS. 5A to 5C, the striking body 4 is struck by a hammer/mallet M or similar repeatedly so that the force of these blows is transmitted through the striking body 4 and the cutting body 2 to the blade 3 to cut through the CMU which the blade 3 is located against. The striking body 4 provides a surface onto which the hammer/mallet M can be struck and helps to ensure that striking forces are received and transmitted effectively. The striking body 4 is a solid, short cylindrical body, with a flat top that helps to ensure that striking forces are received and transmitted effectively. In this embodiment, the striking body 4 is welded to the upper edge of the planar cutting body 2. In alternative embodiments, the striking body could be formed as an integral extension of the body. The striking body 4 is located substantially centrally along the top edge of the cutting body 2. This helps to ensure that striking forces are received and transmitted effectively.

Figure 2:
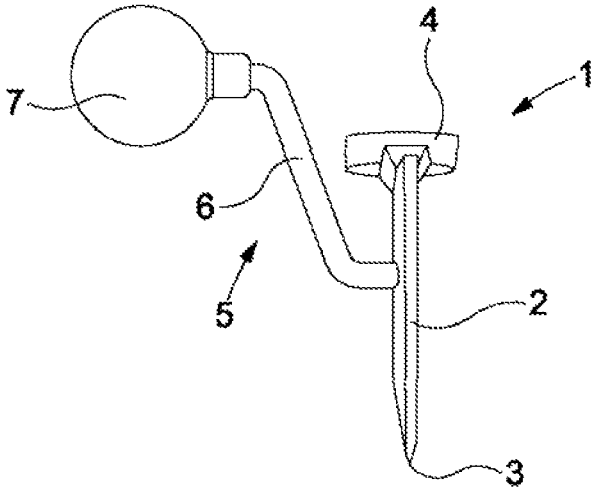
FIG. 2 shows a side elevation view of the long-bladed bolster of FIG. 1.
Figure 3:
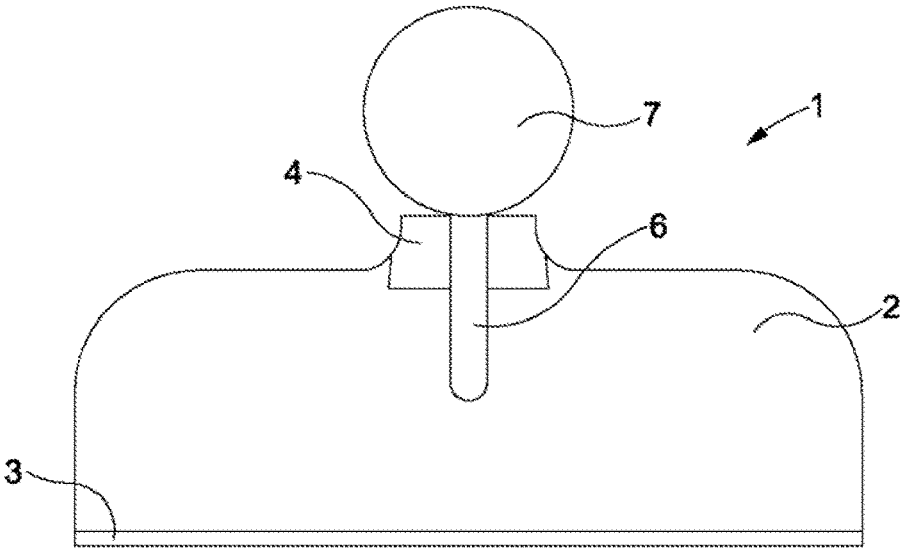
FIG. 3 shows a front elevation view of the long-bladed bolster of FIGS. 1 and 2.
Figure 4:
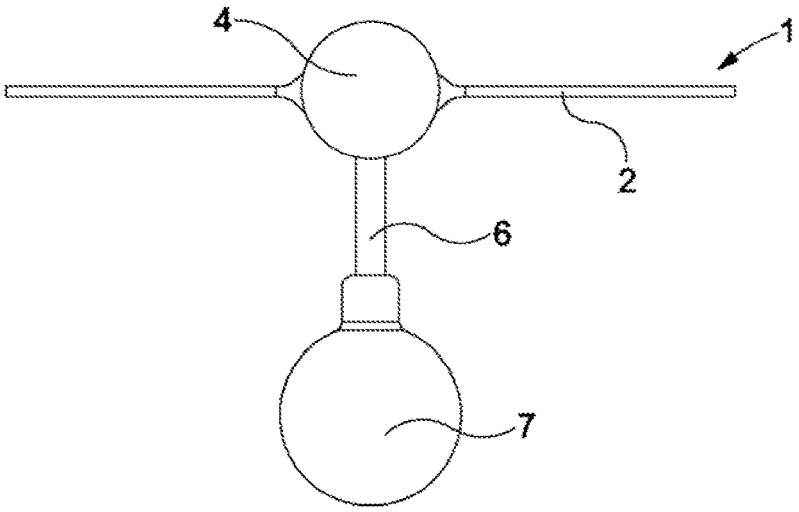
FIG. 4 shows a top plan view of the long-bladed bolster of FIGS. 1 to 3.

The cutting body 2, as best seen in FIGS. 2 and 4, is substantially planar. That is to say that it is a slim plate-like body that may be just a few mm thick (generally up to about 10 mm at most) and may be of uniform thickness or of thickness tapering/narrowing towards the blade 3. It may be wedge-shaped in profile. It serves to cleave the CMU block as the blade passes down into the block. The cutting body 2 is suitably about 70 mm in depth/height from the cutting blade edge 3 to the opposing edge with the striking body 4.

A handle 5 extends from one of the major planar faces of the cutting body 2 substantially centrally along the length of the cutting body 2 for grasping by a user in one hand to position and hold the bolster 1 in position in use. In this embodiment, the handle 5 comprises an arm 6 connected at an inner end to the face of the cutting body 2 and a spherical handle knob 7 configured to fit within a user's hand connected to the outer end.

The arm 6 of handle 5 is bent/cranked into an open 'S' or 'Z' shape (that is, it does not double back on itself) as shown in FIG. 1 so that when connected the handle 5 is angled upwards. This positions the handle knob 7 sufficiently above the surface of the CMU in use to allow a user to keep their hand high clear of the CMU in use, avoiding skinned or bruised knuckles or similar as the hammered bolster 1 cleaves down through the CMU block. The crank of the arm 6 is such that arm 6 presents a low profile at its point of attachment to the cutting body 2 and the steep angle of rise of the arm 6 also helps prevent risk of any impact of the handle arm on the block as it is cleaved. The angle of rise of the arm 6 is preferably greater than 40 degrees and of the order of 50 to 60 degrees from the horizontal plane/plane of the surface of the CMU block being cut into. The arm 6 attachment point to the cutting body 2 is preferably spaced up from the blade edge 3 by a clearance of about 45 mm, eg 40 to 60 mm, to facilitate the cleavage action. The low profile initial part of the arm 6 attached to the cutting body 2 is preferably 25 mm or no more than about 40 mm in length. The height from the bottom crank of arm 6 to top crank of arm 6 is preferably about 60 mm or between 50 mm and 70 mm. The handle grip is preferably about 80 mm in length or between 50 mm and 100 mm.

The invention has been described above by way of example only and it will be appreciated that variation may be made to the above-mentioned embodiments without departing from the scope of invention. Firstly it will be understood that any features described in relation to any particular embodiment may be featured in combinations with other embodiments. With respect to the specification therefore, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention, with variation and implementation obvious and clear on the basis of either common general knowledge or of expert knowledge in the field concerned. Further, since numerous modifications and changes will readily occur to those skilled in the art, it is not desired to limit the invention to the exact construction and operation shown and described, and accordingly, all suitable modifications and equivalents may be resorted to, falling within the scope of the invention as set out in the accompanying claims.

What claimed is:

1. A long-bladed bolster, comprising a substantially planar cutting body having a plane and a first long edge formed as a cutting blade of sufficient length such that the blade is arranged in use to be positioned substantially centrally across a concrete masonry unit (CMU) block that it is mounted on top of to enable the CMU block to be divided without the bolster requiring repositioning, wherein the bolster has a striking body on a second long edge of the cutting body opposite to the cutting blade that is adapted to be struck repeatedly by a striking implement and transmits force therefrom through the cutting body to the blade; and the bolster has an integral handle that extends from the bolster at a location part-way along the length of the cutting body, the handle being spaced above the cutting edge and thereby not resting on the CMU block in use, and extending transverse to the plane of the cutting body, the integral handle being rigidly fixed in position on the cutting body and thereby moving with the cutting body when the striking body of the cutting body is struck;

wherein the blade is at least 200 mm in length.

2. A long-bladed bolster as claimed in claim 1 wherein the handle extends substantially orthogonally to the plane of the cutting body.

3. A long-bladed bolster as claimed in claim 1, wherein the handle extends from the cutting body at a location that is substantially centrally along the length of the cutting body.

4. A long-bladed bolster as claimed in claim 1, wherein the striking body is a solid flat-topped body that is broader than the cutting body.

5. A long-bladed bolster as claimed in claim 1, wherein the striking body is welded to the second long edge of the cutting body.

6. A long-bladed bolster as claimed in claim 1, wherein the striking body is formed as an integral extension of the cutting body.

7. A long-bladed bolster as claimed in claim 1, wherein the striking body is located substantially centrally on the second long edge of the cutting body.

8. A long-bladed bolster as claimed in claim 1, wherein the handle extends from the cutting body and is configured to be grasped by a user in one hand to position and hold the bolster in position.

9. A long-bladed bolster as claimed in claim 1, wherein the handle comprises an arm having an inner end and an outer end and being connected fixed at the inner end to a major face of the cutting body and having a handle knob configured to fit within a user's hand at the outer end.

10. A long-bladed bolster as claimed in claim 9, wherein the arm of the handle is angled upwards.

11. A long-bladed bolster as claimed in claim 9, wherein the arm of the handle is angled upwards at an angle of greater than 45 degrees to horizontal when the bolster is positioned for use with the cutting blade horizontal.

12. A long-bladed bolster as claimed in claim 9, wherein the arm of the handle is joined to the cutting body at a spacing of greater than 30 mm above the first long cutting edge.

* * * * *